US012305329B2

(12) United States Patent
Eriksson

(10) Patent No.: US 12,305,329 B2
(45) Date of Patent: May 20, 2025

(54) SYSTEM AND PROCESS FOR REFINING LIGNOCELLULOSIC BIOMASS MATERIAL

(71) Applicant: VALMET AB, Sundsvall (SE)

(72) Inventor: Per Eriksson, Alnö (SE)

(73) Assignee: VALMET AB, Sundsvall (SE)

( * ) Notice: Subject to any disclaimer, the term of this patent is extended or adjusted under 35 U.S.C. 154(b) by 877 days.

(21) Appl. No.: 17/434,862

(22) PCT Filed: Feb. 12, 2020

(86) PCT No.: PCT/SE2020/050152
§ 371 (c)(1),
(2) Date: Aug. 30, 2021

(87) PCT Pub. No.: WO2020/180225
PCT Pub. Date: Sep. 10, 2020

(65) Prior Publication Data

US 2022/0162798 A1 May 26, 2022

(30) Foreign Application Priority Data

Mar. 1, 2019 (SE) ..... 1950263-2

(51) Int. Cl.
*D21B 1/30* (2006.01)
*D21D 1/30* (2006.01)
*D21D 1/40* (2006.01)

(52) U.S. Cl.
CPC ..... *D21B 1/30* (2013.01); *D21D 1/30* (2013.01); *D21D 1/40* (2013.01)

(58) Field of Classification Search
CPC ..... D21D 1/30
(Continued)

(56) References Cited

U.S. PATENT DOCUMENTS 4,082,233 A 4/1978 Reinhall
4,136,831 A 1/1979 Cederquist et al.
(Continued)

FOREIGN PATENT DOCUMENTS

DE 10 51 624 B 2/1959
EP 1834747 B1 9/2007
WO WO-2018/236269 A1 12/2018

OTHER PUBLICATIONS

Extended European Search Report issued in connection with EP Appl. Ser. No. 20767406.0 dated May 17, 2023.
(Continued)

*Primary Examiner* — Jacob T Minskey
(74) *Attorney, Agent, or Firm* — Foley & Lardner LLP

(57) ABSTRACT

A system (1) for refining lignocellulosic biomass material (A) comprising a presteaming bin (2), a dewatering device (3), a preheater (4), a defibrator (9) comprising at least one refining zone (14) wherein steam is generated during refining of said biomass material so that a pressure peak occurs, a blowpipe (19), and a first steam flow path (D) arranged to convey steam from said refining zone to said presteaming bin (2). The system further comprises a second steam flow path (E) arranged to convey steam from said refining zone to said presteaming bin, wherein said first and second steam flow paths are connected to the refining zone on opposite sides of the pressure peakin a biomass material transport direction, and wherein said first and second steam flow paths are separate from said blow pipe. The invention also relates to a process for refining lignocellulosic biomass material.

17 Claims, 2 Drawing Sheets

(58) Field of Classification Search
USPC ..... 162/28
See application file for complete search history.

(56) References Cited

U.S. PATENT DOCUMENTS

| | | | | |
|---|---|---|---|---|
| 4,298,425 | A | 11/1981 | Ranzen et al. | |
| 4,754,935 | A | 7/1988 | Gullichsen | |
| 4,878,997 | A | 11/1989 | Reinhall | |
| 5,248,099 | A * | 9/1993 | Lahner | D21D 1/303 241/261.3 |
| 2006/0006264 | A1 * | 1/2006 | Sabourin | D21D 1/30 241/261.2 |
| 2012/0018549 | A1 | 1/2012 | Gingras | |
| 2019/0352849 | A1 * | 11/2019 | Shagaev | D21C 3/04 |

OTHER PUBLICATIONS

Tienvieri, T. et al., "Chapter 7: Thermomechanical Pulping", Mechanical Pulping, 1999, pp. 159-221.
Swedish Search Report, Application No. 1950263-2, Sep. 17, 2019, 3 pages.

* cited by examiner

SYSTEM AND PROCESS FOR REFINING LIGNOCELLULOSIC BIOMASS MATERIAL

TECHNICAL FIELD

The invention relates to a system and a process for refining lignocellulosic biomass material.

BACKGROUND

A process for refining lignocellulosic biomass material comprises a refining step wherein said biomass material, e.g. in the form of chips, are mechanically refined in a defibrator.

The chips may be presteamed and preheated before they are conveyed to the defibrator. Presteaming facilitates subsequent compression and dewatering of the chips. Presteaming takes place in a presteaming bin, wherein the chips are exposed to fresh steam that softens the chips and raises the temperature to about 90-100° C. Thereafter, the chips are fed to a dewatering device, e.g. a plug screw feeder, which conveys the chips into the preheater and simultaneously dewaters the chips by squeezing out water. The squeezed-out water contains impurities such as volatile organic compounds (VOC), which in this way are removed from the chips. The plug screw feeder also compresses the chips so that an essentially gas-tight plug is formed within the plug screw feeder to prevent steam from flowing against the biomass transport direction from the pressurized preheater and back through the plug screw feeder. Fresh steam is added to the preheater to raise the pressure within the preheater to about 800-1000 kPa and the temperature to about 175-185° C., so that the temperature of the incoming chips to the defibrator corresponds to the optimal defibration temperature. Inert gases are generated in the preheater when the chips are preheated, and these inert gases may be conveyed through a small vent pipe at the top of the preheater to the presteaming bin, thus preventing inert gases from collecting in the preheater. Thereafter, the chips may be fed from the preheater to the defibrator by means of a pair of conveyor screws, wherein the first conveyor screw may be a plug screw feeder and the second conveyor screw may be a ribbon feeder arranged to convey chips to the defibrator and letting through steam from the defibrator towards the preheater.

The defibrator comprises a refining zone wherein the chips are refined. The refining zone is defined by a rotor element and a stator element or alternatively by two rotor elements, wherein said rotor element(s) grinds the chips into fibers. Steam is generated in the defibrator from the moisture in the chips when the chips are broken down and the fibers are exposed. Steam may also be added to the defibrator to control the pressure, usually about 800-1000 kPa, within the defibrator. In this way, a pressure peak is generated in the refining zone. The pressure peak causes steam generated on one side of the pressure peak to flow in the biomass material transport direction and out of the refining zone and steam generated on the opposite side of the pressure peak to flow against the biomass material transport direction and out of the refining zone. The steam that flows in the biomass material transport direction is utilized as transport steam and propels the fibers through a blow pipe to a separator, wherein steam and fibers are separated. Thereafter, the fibers are conveyed from the separator to a dryer. Steam from the separator may be conveyed to the presteaming bin, thus reducing the amount of fresh steam that must be added to the presteaming bin. This feature also ensures that impurities in the separated steam are conveyed back to the presteaming bin and thereafter squeezed out of the chips in the dewatering device. In other words, recirculation of contaminated steam to the presteaming bin reduces the amount of impurities released into the atmosphere from the dryer. The steam that flows against the biomass material transport direction may be conveyed through the ribbon feeder and a steam conduit to the preheater, thus reducing the amount of fresh steam that must be added to the preheater.

U.S. Pat. No. 4,136,831 relates to a method and apparatus for producing pulp for fiberboard and the like, in which a portion of high-pressure high-temperature steam from a mixture of steam and pulp discharged at an outlet end of a defibrator is recirculated to a preheater arranged to heat presteamed chips. The pressure of said separated portion is increased by means of a compressor, which prevents steam from flowing from the defibrator to the preheater. Steam is also recirculated from a cyclone, wherein steam and pulp are separated, arranged downstream of said defibrator, to a presteaming bin arranged before the defibrator. The object of the invention is to reduce the amount of fresh steam required to the heat the pulp.

EP 1,834,747 B1 relates to a method and apparatus for separating steam from lignocellulose containing fibers. The fibers are refined wetly and forwarded to a dryer through a blow pipe. Steam is separated from the fibers in front of the dryer through a porous partial area of a wall of the blow pipe. Separated steam is returned to the presteaming bin. The object of the invention is to reduce the amount of steam that enters the dryer and thus the energy required for drying the fibers.

All the above described systems and processes include the feature that steam is recycled to the presteaming bin, which reduces the amount of impurities released into the atmosphere. However, these systems are complex and expensive. It is desirable to provide a system and a process that reduce the amount of impurities released into the atmosphere and are inexpensive with a simple design.

OBJECT OF THE INVENTION

It is a first object of the invention to provide a system that minimizes the amount of impurities released into the atmosphere and has an inexpensive and simple design.

It is a second object of the invention to provide a process that minimizes the amount of impurities released into the atmosphere and has an inexpensive and simple design.

SUMMARY

The system and process according to the invention are suitable for use in any system wherein biomass material is broken down into fibers. The system and process according to the invention may, for example, be used in fiberboard production.

A "steam flow path" refers, in this context, to one or more hollow elements, e.g. a steam pipe or steam conduit, a screw feeder or an apparatus for treatment of lignocellulosic material, or portions thereof, connected to form a continuous flow path for steam.

The term "biomass material" or "lignocellulosic biomass material" as used herein refers to a material derived from lignin, cellulose and hemicellulose, such as wood and plants.

The first object of the invention is achieved with a system for refining lignocellulosic biomass material as described in independent claim 1. The system comprises a presteaming bin for presteaming said biomass material, a dewatering device for dewatering said presteamed biomass material, a preheater for preheating said dewatered biomass material, a defibrator comprising at least one refining zone wherein said preheated biomass material is refined and wherein steam is generated during the refining of said biomass material so that a pressure peak occurs in the refining zone, a blow pipe for conveying (refined) biomass material away from the refining zone, and a first steam flow path arranged to convey steam flowing away from the pressure peak against a biomass material transport direction from said refining zone to said presteaming bin. The system further comprises a second steam flow path arranged to convey steam flowing away from the pressure peak in the biomass material transport direction from said refining zone to said presteaming bin. Said first and second steam flow paths are connected to the refining zone on opposite sides of the pressure peak in the biomass material transport direction. Also, said first and second steam flow paths are separate from said blow pipe.

The refining zone may be defined by two opposing refining surfaces of a rotor and a stator or two rotors accommodated in a grinding house. The refining surfaces are located at a distance from one another to define between them a space wherein biomass material is ground into fibers. This space is referred to as the refining zone. Biomass material is fed into an inner portion of the refining zone and ground into fibers by the refining surfaces as it is forced outwards by the rotor(s) towards the periphery of the refining zone. Moisture in the biomass material is converted into steam during the grinding and a pressure peak occurs in the refining zone. Consequently, steam generated within the refining zone on opposite sides of the pressure peak will flow in opposite directions away from the pressure peak. In other words, steam generated outside the pressure peak will flow in the biomass material transport direction towards the periphery of the refining zone whereas steam generated inside the pressure peak will flow against the biomass material transport direction towards the inner portion of the refining zone. The first and second steam flow paths are connected to the refining zone on opposite sides of the pressure peak (i.e. connected to opposite sides of the refining zone), as seen in a biomass material transport direction, to ensure that some of the steam flowing away from the pressure peak is conveyed back to the presteaming bin, where it is used to soften and raise the temperature of the biomass material. Of course, this includes steam generated or added elsewhere in the system and conveyed to the refining zone with the biomass material. Another way to put this is that the first steam flow path is arranged to convey steam flowing away from the pressure peak against the biomass material transport direction whereas the second steam flow path is arranged to convey steam flowing away from the pressure peak in the biomass material transport direction. This arrangement ensures that a portion of the steam, advantageously up to 40%, is recycled from the defibrator to other parts of the system, including the presteaming bin, whereas the rest is used to propel the biomass material through the blow pipe. From this follows that the consumption of fresh steam in the presteaming bin is reduced. Also, the steam returned to the presteaming bin from the defibrator contains impurities, and these impurities are removed in the subsequently arranged dewatering device, e.g. a plug screw feeder, when the water is squeezed out of the biomass material. The polluted water may then be transported to a suitable treatment device. Thus, the system according to the invention significantly reduces the amount of impurities released into the atmosphere. Also, the system does not require a separate apparatus for separation of steam and biomass material, i.e. it has a simple and inexpensive design.

At least one of said first and second steam flow paths may comprise at least a portion of said preheater, thus allowing steam from the defibrator to be conveyed to the preheater where it is used to preheat the biomass material. This arrangement reduces the amount of fresh steam required to heat the biomass material to the optimal defibration temperature in the preheater. However, it may still be necessary to add some fresh steam to the preheater to maintain the optimal pressure and temperature therein. Steam may then be conveyed from the preheater to the presteaming bin via at least one steam conduit that connects the top portion of the preheater and the presteaming bin. Advantageously, this steam conduit has a diameter of between 100-300 mm and is adapted to convey steam to the presteaming bin. This steam conduit may be provided with a valve that allows regulation of the steam flow from the preheater to the presteaming bin, so that the optimal pressure and temperature can be maintained in the preheater.

It is known to use a screw feeder, e.g. a ribbon feeder, to feed preheated chips to the defibrator. Steam that flows against the biomass material transport direction away from the pressure peak in the refining zone may be conveyed through a center portion of this screw feeder. Thus, the screw feeder, or at least a portion thereof, becomes a part of the first steam flow path. Steam that flows through the first screw feeder may then be conveyed, e.g. via a steam conduit, to the preheater or directly to the presteaming bin.

The dewatering device is a device configured to remove moisture from the biomass material. The dewatering device may, for example, be arranged to compress the biomass material, so that water and impurities are squeezed out of the biomass material. This polluted water may then be conveyed to a suitable treatment device. The dewatering device may, for example, be a plug screw feeder adapted to convey biomass material towards the preheater. A plug screw feeder is advantageous in that the biomass material is compressed within a narrowing section of the plug screw feeder to form an essentially airtight plug that prevents steam from the preheater to flow against the biomass material transport direction through the plug screw feeder to the presteaming bin. That is, the plug maintains the pressure within the preheater.

The lateral extension of the refining zone may be defined by two opposing refining surfaces accommodated within a grinding house, wherein at least one of said refining surfaces is rotatable relative the opposing refining surface around an axis of rotation essentially perpendicular to the opposing refining surface. The refining surfaces may, for example, constitute the opposing surfaces of a rotor and a stator, or alternatively the opposing surfaces of two rotors. The refining zone may have a width (the distance between the opposing refining surfaces) of about 0.1 mm. Moisture in the biomass material is transformed into steam when the biomass material is ground into fibers between the refining surfaces.

The heavier refined biomass material is thrown by the rotor(s) towards a peripheral portion of the grinding house whereas the lighter steam accumulates inside of said peripheral portion. Advantageously, the blow pipe is connected to said peripheral portion, arranged to receive the refined biomass material propelled out of the refining zone, and the first and second steam flow paths are connected to said refining zone inside of said peripheral portion. This arrangement ensures that the defibrator functions as a separator for separation of steam and refined biomass material, so that steam generated in the refining zone in the grinding house can be easily separated from the refined biomass material and transported to the presteaming bin. This feature also eliminates the need for a separator arranged downstream of the defibrator for separation of steam and biomass material.

Advantageously, the second steam flow path is connected to an outermost portion of the refining zone but inside said peripheral portion. Thus, it is ensured that as much steam as possible is returned to the presteaming bin via the second steam flow path. In embodiments wherein the defibrator comprises more than one refining zone, the second steam flow path is advantageously connected to an outermost portion of the outermost refining zone but inside said peripheral portion.

The first steam flow path may comprise a steam conduit that directly connects the defibrator and the presteaming bin. However, the first steam flow path may comprise any number of suitable elements (e.g. a pipe, a preheater, a feed screw etc.), or portions thereof, arranged between the refining zone and the presteaming bin.

The second steam flow path may comprise a steam conduit that directly connects the defibrator and the presteaming bin. However, the second steam flow path may comprise any number of suitable elements (e.g. a pipe, a preheater, a feed screw etc.), or portions thereof, arranged between the refining zone and the presteaming bin.

The first steam flow path may comprise at least one valve configured to regulate the steam flow through the first steam flow path. This valve is used to maintain the optimal pressure within the defibrator and/or the optimal temperature within the presteaming bin.

The second steam flow path may comprise at least one valve configured to regulate the steam flow through the second steam flow path. This valve is used to maintain the optimal pressure within the defibrator and/or the optimal temperature within the presteaming bin.

In embodiments wherein a flow path conveys steam to the presteaming bin via the preheater, a valve may be arranged within said flow path between the defibrator and the preheater and another valve within said flow path between the preheater and the presteaming bin. These valves are used to regulate the steam flow through said flow path to maintain the optimal pressure within the defibrator, the optimal temperature within the presteaming bin and/or the optimal pressure and temperature within the preheater.

Advantageously, the system comprises a blow valve configured to regulate the flow of steam through the blow pipe.

The system may comprise pressure and temperature sensors configured to measure the pressure and temperature in different parts of the system. Advantageously, said system comprises a temperature sensor configured to determine the temperature within the presteaming bin. Advantageously, said system comprises one or more sensors configured to determine the pressure and temperature within the preheater. Advantageously, said system comprises a sensor configured to determine the pressure within the defibrator.

The system may also comprise a control unit adapted to control one or more of the valves within the system, based on data received from said sensors, to maintain the optimal pressure and temperature within specific parts of the system.

The second object of the invention is achieved with a process for refining lignocellulosic biomass material according to claim 7. The process comprises the steps of presteaming said biomass material in a presteaming bin, dewatering said biomass material in a dewatering device, preheating said biomass material in a preheater, refining said biomass material in a refining zone in a defibrator and generating steam during the refining of said biomass material so that a pressure peak occurs in the refining zone, conveying biomass material away from the refining zone through a blow pipe, and conveying steam flowing away from the pressure peak against a biomass material transport direction from said refining zone to said presteaming bin through a first steam flow path. The process further comprises the step of conveying steam flowing away from the pressure peak in the biomass material transport direction from said refining zone to said presteaming bin through a second steam flow path. Furthermore, said first and second steam flow paths are connected to the refining zone on opposite sides of the pressure peak in the biomass material transport direction, and said first and second steam flow paths are separate from said blow pipe.

Steam generated in the refining zone flows away from the pressure peak. Some of the steam will flow out of the refining zone in the biomass material transport direction and some of it will flow out of the refining zone against the biomass material transport direction. Using at least two flow paths connected to the refining zone on opposite sides of the pressure peak ensures that steam in both steam flows will be conveyed to the presteaming bin, wherein the recycled steam is used to presteam biomass material. The recycled steam contains impurities, and when the biomass material is subsequently compressed in the dewatering device, these impurities will be removed with the water squeezed out of the biomass material. Thus, the present invention minimizes the amount of impurities released into the atmosphere. It also reduces the amount of fresh steam that must be added to the presteaming bin. The process according to the invention does not require a separate apparatus for separating steam and biomass material and is therefore simple and inexpensive.

Advantageously, the second steam flow path is connected to an outermost portion of the refining zone but inside the peripheral portion of the defibrator. Thus, it is ensured that as much steam as possible is returned to the presteaming bin via the second steam flow path. In embodiments wherein the defibrator comprises more than one refining zone, the second steam flow path is advantageously connected to an outermost portion of the outermost refining zone but inside said peripheral portion.

The process may further comprise the step of conveying steam to said presteaming bin via said preheater, i.e. at least one of said first and second steam flow paths comprises at least a portion of said preheater. Thus, recycled steam from the defibrator may be used to raise the temperature and pressure within the preheater, thus reducing the consumption of fresh steam in the preheater.

The process may further comprise the step of conveying steam to said presteaming bin via said first steam flow path, which comprises at least a portion of a screw feeder arranged to convey biomass material to said defibrator. This solution is particularly advantageous when the screw feeder is a ribbon feeder that allows steam to pass through a center portion of the ribbon feeder.

Also, the position of the pressure peak within the refining zone may be adjusted by means of fresh steam added to the grinding house.

The process may comprise the step of using at least one valve to regulate the steam flow through the first steam flow path to maintain the optimal pressure within the defibrator and/or the optimal temperature within the presteaming bin.

The process may comprise the step of using at least one valve to regulate the steam flow through the second steam flow path to maintain the optimal pressure within the defibrator and/or the optimal temperature within the presteaming bin.

In embodiments wherein a flow path conveys steam to the presteaming bin via the preheater, a valve may be arranged within said flow path between the defibrator and the preheater and another valve within said flow path between the preheater and the presteaming bin. The process may comprise the step of using these valves to regulate the steam flow through said flow path to maintain the optimal pressure within the defibrator, the optimal temperature within the presteaming bin and/or the optimal temperature and pressure within the preheater.

The process may comprise the step of using a blow valve to regulate the flow of steam through the blow pipe.

The process may comprise the step of using pressure and temperature sensors to measure the pressure and temperature in different parts of the system. Advantageously, said process comprises the step of using a temperature sensor to determine the temperature within the presteaming bin. Advantageously, said process comprises the step of using one or more sensors configured to determine the pressure and temperature within the preheater. Advantageously, said process comprises the step of using a sensor to determine the pressure within the defibrator.

The process may also comprise the step of using a control unit to control one or more of the valves within the system, based on data received from said sensors, to maintain the optimal pressure and temperature within specific parts of the system.

BRIEF DESCRIPTION OF THE DRAWINGS

These and other aspects of the present invention will now be described in more detail with reference to the appended drawings, wherein some parts have been removed for the sake of clarity, and wherein.

DETAILED DESCRIPTION

Figure 1:
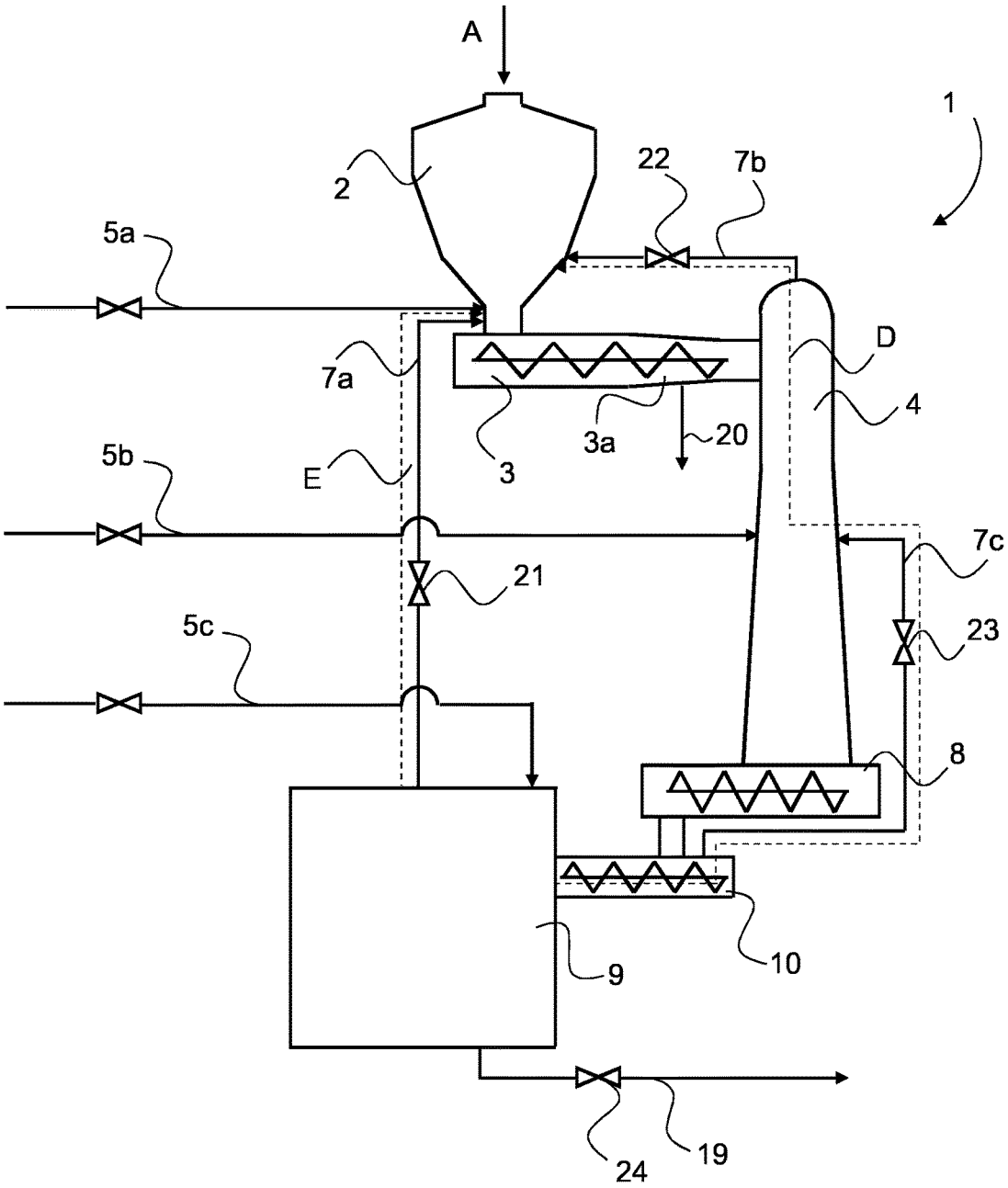
FIG. 1 is a schematic illustration of a system according to a first embodiment of the invention.

FIG. 1 shows a schematic illustration of a system 1 for refining lignocellulosic biomass material according to a first embodiment of the invention.

Biomass material A, e.g. in the form of wood chips, is fed into a top portion of a presteaming bin 2 by means of a screw feeder (not shown). Fresh steam is injected into the presteaming bin 2 through a steam pipe 5*a* and recycled steam is injected into the presteaming bin 2 through two steam conduits 7*a*, 7*b* connected to a defibrator 9 and a preheater 4, respectively. The injected steam softens the biomass material and raises the temperature of the biomass material to about 90-100° C. The presteamed biomass material is then expelled through a lower portion of the presteaming bin 2 and received in a dewatering device 3. In this embodiment, the dewatering device 3 is a plug screw feeder arranged to convey the biomass material to the preheater 4. The plug screw feeder comprises a narrowing section 3*a* wherein the biomass material is compressed to form an airtight plug that prevents steam from the preheater 4 from streaming back through the plug screw feeder. Moisture is squeezed out of the biomass material in the dewatering device 3 and water containing impurities, such as VOCs, is conveyed through a conduit 20 to a suitable treatment device (not shown).

An upper portion of the preheater 4 comprises an inlet arranged to receive biomass material from the dewatering device 3. Steam is injected into the preheater 4 to raise the temperature to about 175-185° C. and the pressure to about 800-1000 kPa. Fresh steam is injected through a steam pipe 5*b* and recycled steam is injected through a steam conduit 7*c*. The biomass material is preheated in the preheater 4 and then expelled from a lower portion of the preheater 4 into a first screw feeder 8. A small plug of biomass material may be created in the first screw feeder 8 to maintain the pressure within the preheater 4. The biomass material is then conveyed to a defibrator 9 by means of a second screw feeder 10. In this embodiment, the second screw feeder 10 is a ribbon feeder that permits steam from the defibrator 9 to flow back through a central region of the ribbon feeder. The steam conduit 7*c* is connected to the second screw feeder 10 and conveys steam from the second screw feeder 10 to the preheater 4.

Figure 2:
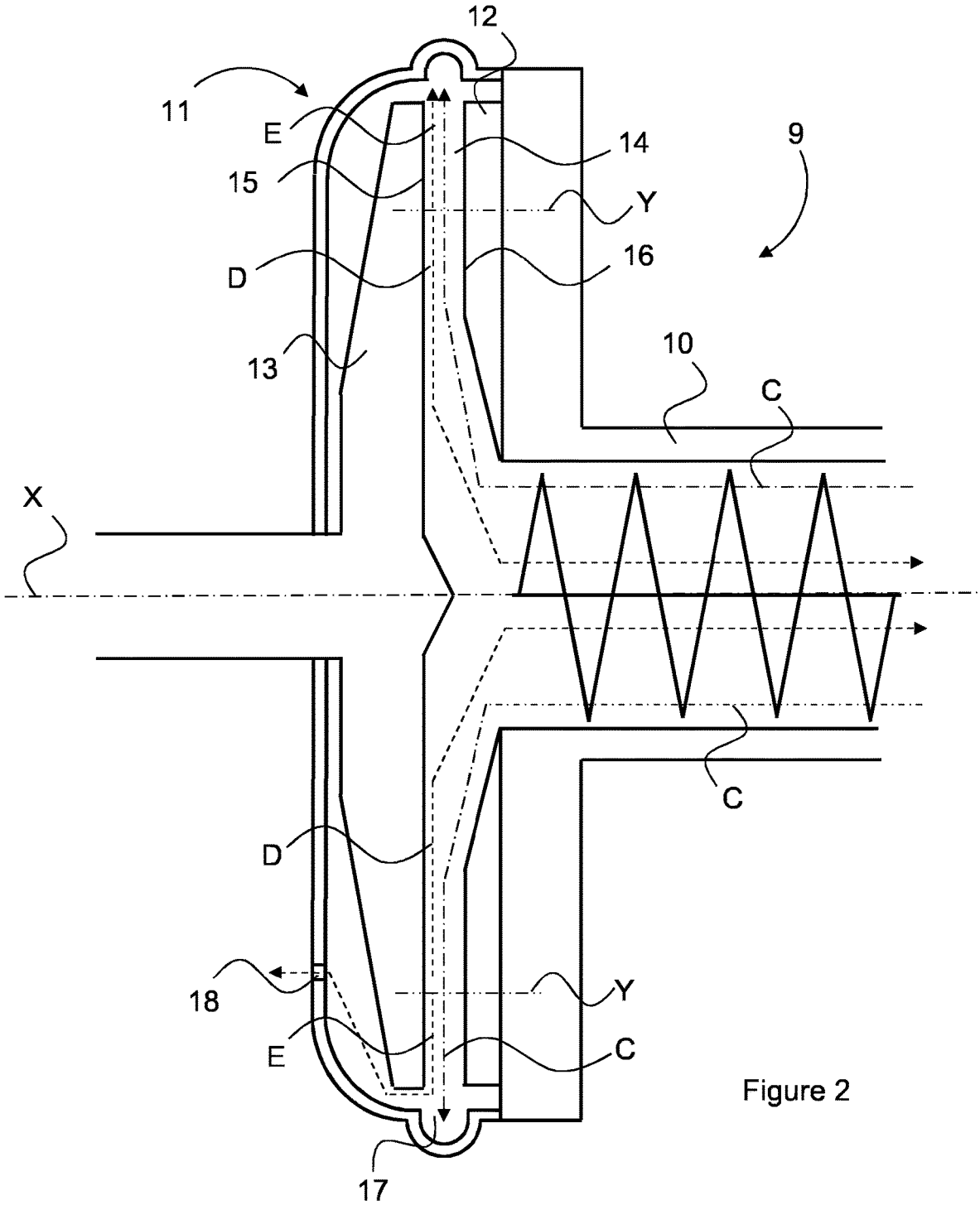
FIG. 2 shows a cross section through a portion of the defibrator in FIG. 1.

Now referring to FIG. 2, is shown a cross section through a portion of the defibrator 9 in FIG. 1.

The defibrator 9 comprises a grinding house 11 accommodating a stationary stator body 12 and a rotating rotor body 13. The rotor body 13 is rotatable around its axis of rotation X by means of a motor (not shown). The stator body 12 and the rotor body 13 are provided with opposing refining surfaces 15, 16, which between them define a refining zone 14. The biomass material is fed (arrows C) from the second screw feeder 10 into the refining zone 14 where the biomass material is broken down by the refining surfaces 15, 16 when the rotor body 13 is rotated around its axis of rotation X. The refining surfaces 15, 16 are provided with radial grooves (not shown) for this specific purpose. The refined biomass material is forced by the centrifugal force towards an outer periphery of the refining surfaces 15, 16, where the grooves are finer to produce fibers, and from there to a peripheral portion 17 of the grinding house 11. Thereafter, the fibers are conveyed to subsequent processing equipment (not shown), e.g. a dryer, via blow pipe 19 (see FIG. 1) connected to said peripheral portion 17.

Moisture in the biomass material is converted into steam when the biomass material is broken down into fibers in the refining zone 14. A pressure peak (indicated by axes Y) is generated within the refining zone 14. The position of the pressure peak depends on a plurality of parameters and steam may be injected into the grinding house 11 through steam pipe 5*c* (see FIG. 1) to adjust the position of the pressure peak. Steam generated within the refining zone 14 flows away from the pressure peak. That is, steam generated inside the pressure peak flows against the biomass material transport direction back through the refining zone 14 and through a center portion of the second screw feeder 10, whereas steam generated outside the pressure peak flows in the biomass material transport direction towards an outer periphery of the refining zone 14. The heavier refined fibers are thrown by the rotor 13 towards the peripheral portion 17 of the grinding house 11 and the blow pipe 19 whereas the lighter steam will accumulate further towards the center of the grinding house 11 and exit through an opening 18 located between the peripheral portion 17 and the axis of rotation X. This steam is then conveyed to the presteaming bin through steam conduit 7*a* (see FIG. 1).

The steam injected into the grinding house 11 through steam pipe 5*c* may, for example, be injected near opening 18.

Now referring to FIGS. 1 and 2, steam is conveyed from the refining zone 14 in the defibrator 9 to the presteaming bin 2 through a first steam flow path D and a second steam flow path E.

In this embodiment, the first steam flow path D comprises a portion of the second screw feeder 10, the steam conduit 7*c*, a portion of the preheater 4 and the steam conduit 7*b*. That is, steam is conveyed from the refining zone 14 in the defibrator 14 via the second screw feeder 10 and the steam conduit 7*c* to the preheater 4, where the recycled steam is used to preheat the biomass material at optimal pressure, thus reducing the amount of fresh steam that must be added to the preheater 4 through steam pipe 5*b*. Thereafter, steam is conveyed via steam conduit 7*b* to the presteaming bin 2, where the recycled steam is used to soften and preheat the biomass material, thus reducing the amount of fresh steam that must be added to the presteaming bin 2 through steam pipe 5*a*.

In this embodiment, the second steam flow path E comprises a portion of the grinding house 11, the opening 18 and steam conduit 7*a*. That is, steam is conveyed from the refining zone 14 in the defibrator via the grinding house 11, the opening 18 and the steam conduit 7*a* to the presteaming bin 4, where the recycled steam is used to soften and preheat the biomass material, thus reducing the amount of fresh steam that must be added to the presteaming bin 2 through steam pipe 5*a*.

The blow pipe 19 is provided with a blow valve 24 that is used to regulate the steam flow through the blow pipe. Usually, about 60-80% of the steam in the defibrator 9 is conveyed through the blow pipe 19 to convey the biomass material to subsequent processing equipment. Steam conduits 7*a-c* are provided with valves 21, 22, 23 configured for regulation of the steam flows through the first and second steam flow paths D, E. These valves are used to ensure that the optimal temperature and pressure is maintained in the presteaming bin 2, the preheater 4 and the defibrator 9. Advantageously, a control unit (not shown) is configured to regulate the valves in the system 1 based on data received from temperature and pressure sensors (not shown) configured to determine the temperature and/or pressure in the presteaming bin 2, the preheater 4 and the defibrator 9.

In alternative embodiments, the first and second steam flow paths D, E may be arranged differently and may comprise any number of suitable elements or portions thereof.

For example, the first and/or second steam flow paths D, E may comprise a portion of steam pipe 5*a*.

For example, in an alternative embodiment, steam conduit 7*c* may be used to convey steam directly from the second screw feeder 10 to the presteaming bin 2, thus bypassing the preheater 4 and steam conduit 7*b*, so that the first steam flow path comprises a portion of the second screw feeder 10 and steam conduit 7*c* only.

Also, in an alternative embodiment, steam conduit 7*a* may be used to convey steam from the refining zone 14 in the defibrator 9 to the preheater 4, so that the second steam flow path comprises a portion of the grinding house 11, the opening 18, steam conduit 7*a*, the preheater 4 and steam conduit 7*b*.

In yet another embodiment, both the first and second steam flow paths may be used to convey steam from the refining zone 14 in the defibrator 9 to the preheater 4, thus further reducing the amount of fresh steam that must be added to the preheater 4.

As mentioned above, steam that is conveyed from the defibrator 9 to the presteaming bin 2 contains impurities, such as VOCs. These impurities will be removed from the biomass material when water containing said impurities is squeezed out of the biomass material in the dewatering device 3. Thus, the system according to the invention ensures that the amount of impurities that is released into the atmosphere is minimized.

Some of the steam generated in the defibrator 9 is used to propel the biomass material through blow pipe 19. This steam may be separated from the biomass material in a separator (not shown) and conveyed back to the presteaming bin 2, thus further reducing the amount of impurities that is released into the atmosphere.

The description above and the appended drawings are to be considered as non-limiting examples of the invention. The person skilled in the art realizes that several changes and modifications may be made within the scope of the invention. For example, one or more of the steam pipes for fresh steam may be superfluous, and may be removed, if the amount of recycled steam is sufficient for presteaming and/or preheating the biomass material. As mentioned, the first and second steam flow paths may comprise any number of suitable elements or portions thereof. Also, it is possible to add additional steam flow paths for conveying steam from the refining zone in the defibrator to the presteaming bin. Finally, one or more steam flow paths may merge at some point between the refining zone and the presteaming bin and form a joint steam flow path portion, i.e. said joint steam flow path portion becomes a part of both steam flow paths.

The invention claimed is:

1. A system for refining lignocellulosic biomass material, the system comprising:

a presteaming bin for presteaming the biomass material;

a dewatering device for dewatering the biomass material, the dewatering device being downstream of the presteaming bin in a biomass material transport direction;

a preheater for preheating the biomass material, the preheater being downstream of the dewatering device in the biomass material transport direction;

a defibrator comprising at least one refining zone configured to refine the biomass material, wherein steam is generated during the refining of the biomass material such that a pressure peak occurs in the refining zone;

a blow pipe for conveying the biomass material away from the refining zone;

a first steam flow path arranged to convey a first portion of the steam flowing away from the pressure peak against the biomass material transport direction from the refining zone to the presteaming bin; and a second steam flow path arranged to convey a second portion of the steam flowing away from the pressure peak in the biomass material transport direction from the refining zone to the presteaming bin;

wherein the first and second steam flow paths are connected to the refining zone on opposite sides of the pressure peak in the biomass material transport direction; and wherein the first and second steam flow paths are separate from the blow pipe.

2. The system according to claim 1, wherein at least one of the first steam flow path or the second steam flow path comprises at least a portion of the preheater.

3. The system according to claim 1, wherein the first steam flow path comprises at least a portion of a screw feeder arranged to convey the biomass material to the defibrator.

4. The system according to claim 1, wherein the dewatering device is a plug screw feeder arranged to convey the biomass material towards the preheater.

5. The system according to claim 1, wherein:

the refining zone is defined by two opposing refining surfaces accommodated within a grinding house; and at least one of the refining surfaces is rotatable around an axis of rotation relative the other refining surface.

6. The system according to claim 5, wherein the blow pipe is connected to a peripheral portion of the grinding house and the first and second steam flow paths are connected to the refining zone inside of the peripheral portion.

7. The system according to claim 1, further comprising:

a first conduit fluidly coupled between the defibrator and the preheater, wherein the first steam flow path comprises at least a portion of the first conduit; and a second conduit fluidly coupled between the preheater and the presteaming bin, wherein the first steam flow path comprises at least a portion of the second conduit.

8. The system according to claim 7, further comprising:

a third conduit fluidly coupled between the defibrator and the presteaming bin, wherein the second steam flow path comprises at least a portion of the third conduit.

9. The system according to claim 8, wherein the third conduit is directly coupled between the defibrator and the presteaming bin such that the second portion of the steam is conveyed directly from the defibrator to the presteaming bin through the third conduit.

10. A process for refining lignocellulosic biomass material, the process comprising the steps of:

presteaming the biomass material in a presteaming bin;

dewatering the biomass material in a dewatering device, the dewatering device downstream of the presteaming bin in a biomass material transport direction;

preheating the biomass material in a preheater, the preheater downstream of the dewatering device in the biomass material transport direction;

refining the biomass material in a refining zone in a defibrator and generating steam during the refining of the biomass material such that a pressure peak occurs in the refining zone;

conveying the biomass material away from the refining zone via a blow pipe;

conveying a first portion of the steam flowing away from the pressure peak against the biomass material transport direction from the refining zone to the presteaming bin via a first steam flow path; and conveying a second portion of the steam flowing away from the pressure peak in the biomass material transport direction from the refining zone to the presteaming bin via a second steam flow path;

wherein the first and second steam flow paths are connected to the refining zone on opposite sides of the pressure peak in the biomass material transport direction; and wherein the first and second steam flow paths are separate from the blow pipe.

11. The process according to claim 10, wherein at least one of the first steam flow path or the second steam flow path comprises at least a portion of the preheater.

12. The process according to claim 10, wherein the first steam flow path comprises at least a portion of a screw feeder arranged to convey biomass material to the defibrator.

13. The process according to claim 10, wherein the refining zone is defined by two opposing refining surfaces accommodated within a grinding house, wherein at least one of the refining surfaces is rotatable around an axis of rotation relative the other refining surface.

14. The process according to claim 13, wherein the blow pipe is connected to a peripheral portion of the grinding house and the first and second steam flow paths are connected to the refining zone inside of the peripheral portion.

15. The process according to claim 10, wherein the first steam flow path comprises:

at least a portion of a first conduit fluidly coupled between the defibrator and the preheater; and at least a portion of a second conduit fluidly coupled between the preheater and the presteaming bin.

16. The process according to claim 15, wherein the second steam flow path comprises at least a portion of a third conduit fluidly coupled between the defibrator and the presteaming bin.

17. The process according to claim 16, wherein the third conduit is directly coupled between the defibrator and the presteaming bin such that the second steam flow path extends directly from the defibrator to the presteaming bin through the third conduit.

* * * * *